US010978089B2

(12) United States Patent
Hu et al.

(10) Patent No.: US 10,978,089 B2
(45) Date of Patent: Apr. 13, 2021

(54) METHOD, APPARATUS FOR BLIND SIGNAL SEPARATING AND ELECTRONIC DEVICE

(71) Applicant: Nanjing Horizon Robotics Technology Co., Ltd., Nanjing (CN)

(72) Inventors: Yuxiang Hu, Nanjing (CN); Changbao Zhu, Nanjing (CN)

(73) Assignee: NANJING HORIZON ROBOTICS TECHNOLOGY CO., LTD., Nanjing (CN)

( * ) Notice: Subject to any disclaimer, the term of this patent is extended or adjusted under 35 U.S.C. 154(b) by 60 days.

(21) Appl. No.: 16/555,166

(22) Filed: Aug. 29, 2019

(65) Prior Publication Data

US 2020/0082838 A1 Mar. 12, 2020

(30) Foreign Application Priority Data

Sep. 7, 2018 (CN) ..... 201811045478.0

(51) Int. Cl.

| | |
|---|---|
| ***G10L 21/00*** | (2013.01) |
| ***G10L 25/00*** | (2013.01) |
| ***G10L 21/028*** | (2013.01) |
| ***G10L 25/84*** | (2013.01) |

(52) U.S. Cl.

CPC ..... *G10L 21/028* (2013.01); *G10L 25/84* (2013.01)

(58) Field of Classification Search

CPC ..... G10L 21/028; G10L 25/84

See application file for complete search history.

(56) References Cited

U.S. PATENT DOCUMENTS

| | | | | |
|---|---|---|---|---|
| 9,047,867 | B2 * | 6/2015 | Smaragdis | G10L 15/142 |
| 2008/0053295 | A1 * | 3/2008 | Goto | G10H 3/125 84/616 |
| 2009/0254338 | A1 * | 10/2009 | Chan | G10L 21/0272 704/205 |

* cited by examiner

*Primary Examiner* — Ibrahim Siddo

(74) *Attorney, Agent, or Firm* — Loeb & Loeb LLP

(57) ABSTRACT

Disclosed are a method and an apparatus for blind signal separation and an electronic device. The method includes modeling a sound source with a complex Gaussian distribution to determine a probability density distribution of the sound source; updating a blind signal separation model based on the probability density distribution; and separating an audio signal with the updated blind signal separation model to obtain a plurality of separated output signals. In this way, the blind signal separation model may be updated through the probability density distribution of the sound source obtained based on the complex Gaussian distribution, thereby effectively improving separation performance of a blind signal separation algorithm in specific scenario.

16 Claims, 5 Drawing Sheets

METHOD, APPARATUS FOR BLIND SIGNAL SEPARATING AND ELECTRONIC DEVICE

TECHNICAL FIELD OF THE DISCLOSURE

The present disclosure relates to an audio signal processing technology, and more particularly, to a method for separating a blind signal, an apparatus for separating a blind signal, and an electronic device.

BACKGROUND

A "cocktail party" is one of the most challenging problems in speech enhancement systems, and the difficulty thereof lies in a requirement of separating and extracting a speech signal of a desired speaker from a noisy environment including music, vehicle noise and other human voices, while a human auditory system may easily extract an interested audio signal from this environment.

An existing solution is to use a blind signal separation system to simulate a human auditory system, i.e., to recognize and enhance a sound from a specific sound source.

However, there still is a problem in the existing blind signal separation system, such as adaptability to specific scenario. For example, a blind signal separation algorithm based on a multivariate Laplace distribution may be applied to most of the acoustic signals and may be extended to a real-time processing scenario, however, for some signals with a specific spectral structure, such as music signals with a harmonic structure, a multivariate Laplace model cannot well describe such signals. Further, a blind signal separation algorithm based on a harmonic model may effectively separate a mixed signal of voice and music, but for the harmonic model, it assumes that variance of separation signals is 1, which needs a whitening operation, therefore, it is only suitable for an off-line scenario and cannot be extended to a real-time processing scenario.

Therefore, it is still desirable to provide an improved blind signal separation solution.

SUMMARY

In order to solve the above technical problems, the present disclosure is provided. Embodiments of the present disclosure provide a method and an apparatus for blind signal separation and an electronic device, which update a blind signal separation model by the probability density distribution of a sound source obtained based on a complex Gaussian distribution, thereby effectively improving separation performance of a blind signal separation algorithm in a specific scenario.

According to one aspect of the present disclosure, disclosed is a method for blind signal separation, comprising: modeling a sound source by a complex Gaussian distribution to determine a probability density distribution of the sound source; updating a blind signal separation model based on the probability density distribution; and separating an audio signal by the updated blind signal separation model to obtain a plurality of separated output signals.

According to one aspect of the present disclosure, disclosed is an apparatus for blind signal separation, comprising: a modeling unit configured to model a sound source by a complex Gaussian distribution to determine a probability density distribution of the sound source; an updating unit configured to update a blind signal separation model based on the probability density distribution of the sound source; and a separation unit configured to separate an audio signal by the updated blind signal separation model to obtain a plurality of separated output signals.

According to another aspect of the present disclosure, disclosed is an electronic device, comprising a processor, and a memory having computer program instructions stored therein, the computer program instructions enabling the processor to perform the method for blind signal separation as described above when executed.

According to still another aspect of the present disclosure, disclosed is a computer-readable storage medium having computer program instructions stored thereon, the computer program instructions enabling the processor to perform the method for blind signal separation as described above when executed.

Compared with the prior art, a method for blind signal separation, an apparatus for blind signal separation and an electronic device provided by the present disclosure may model a sound source by a complex Gaussian distribution to determine a probability density distribution of the sound source; update a blind signal separation model based on the probability density distribution of the sound source; and separate an audio signal by the blind signal separation model to obtain a plurality of separated output signals. In this way, the separation performance of the blind signal separation algorithm in a specific scenario may be effectively improved, such as for real-time separation of a music signal with harmonic structures.

BRIEF DESCRIPTION OF THE DRAWINGS

The above and other objects, features and advantages of the present disclosure will become more obvious by describing the embodiments of the present disclosure in more detail with reference to the accompanying drawings. The drawings are used to provide a further understanding of the embodiments of the present disclosure and constitute a portion of the specification, and the drawings, together with the embodiments of the present disclosure, are used to explain this disclosure and do not constitute a limitation. In the drawings, the same reference numbers generally refer to the same portion or step.

DETAILED DESCRIPTION

Hereinafter, an exemplary embodiment of the present disclosure will be described in detail with reference to the drawings. Obviously, the described embodiments are only a portion of the embodiments of the present disclosure and not all the embodiments of the present disclosure, and it should be understood that the present disclosure is not limited by the exemplary embodiments described herein.

SUMMARY OF THE DISCLOSURE

As described above, the existing system for blind signal separation still has defects such as the adaptability to a specific scenario. The reason is that an existing blind signal separation algorithm uses a multivariate Laplacian model based on a multivariate Laplacian distribution, which may be applied to most of the acoustic signals and may be extended to a real-time processing scenario, however, for some signals with specific spectral structures, such as music signals with harmonic structures, the multivariate Laplace model cannot well describe such signals. In another aspect, if a harmonic model adopting a super-gaussian distribution is used, though mixed signals of voice and music may be effectively separated, the harmonic model is assumed to have variance 1 of separated signals, which need to do a whitening operation, therefore, it is only suitable for an off-line scenario and cannot be extended to a real-time processing scenario.

Based on the above technical problem, the basic concept of the present disclosure is to model on the basis of a complex Gaussian distribution and replace the multivariate Laplacian model or the harmonic model in the conventional separation algorithm. According to a specific application scenario, a modeling process may be offline modeling or online modeling, and the blind signal separation model is iteratively updated based on the modeling, thereby improving the separation performance of blind signal separation algorithm in a specific scenario.

Specifically, a method for blind signal separation, an apparatus for blind signal separation and an electronic device provided by the present disclosure firstly model a sound source by using a complex Gaussian distribution to determine a probability density distribution of the sound source, then update a blind signal separation model based on the probability density distribution of the sound source, and finally separate an audio signal by using the blind signal separation model to obtain a plurality of separated output signals. Thus, the separation performance of blind signal separation algorithm in a specific scenario may be effectively improved, such as for real-time separation of music signals with harmonic structures.

After introducing the basic principles of the present disclosure, various non-limiting embodiments of the present disclosure will be specifically described below with reference to the drawings.

Exemplary System

Figure 1:
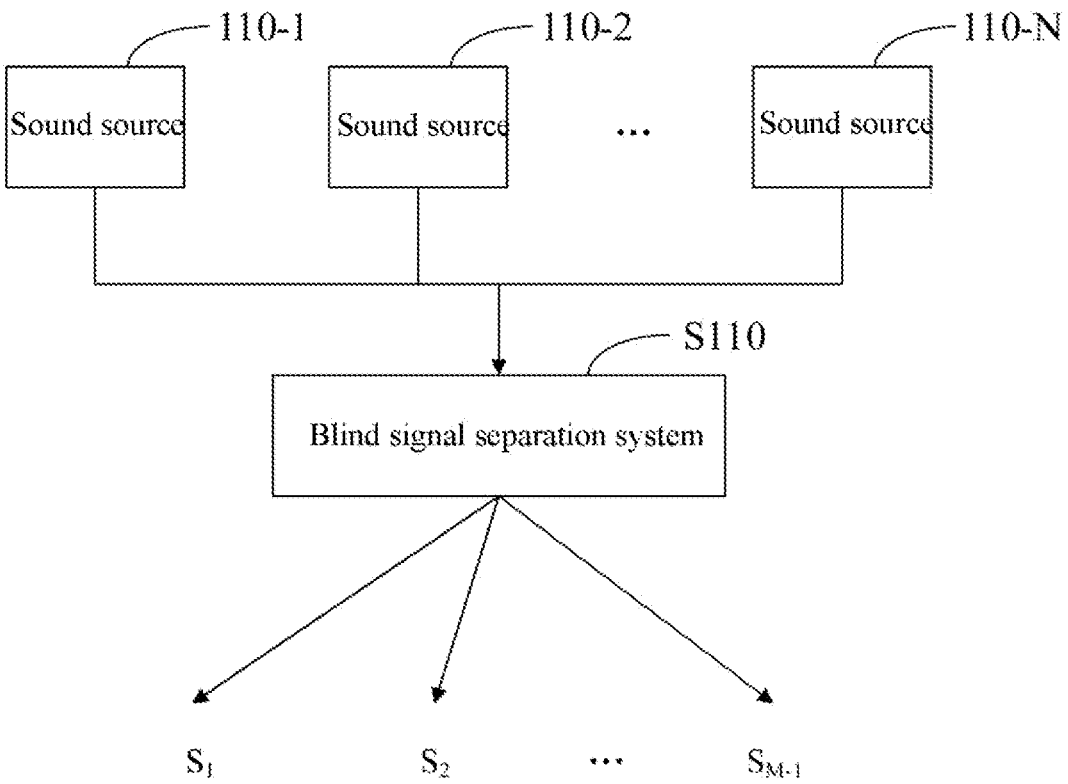
FIG. 1 shows a schematic diagram of an application scenario of a method for blind signal separation according to an embodiment of the present disclosure.

FIG. 1 shows a schematic diagram of an application scenario of a blind signal separation technology according to an embodiment of the present disclosure.

As shown in FIG. 1, a blind signal separation system S110 may receive sound signals from a plurality of sound sources 110-1, 110-2, . . . , 110-N, and each sound source may be a known sound source, such as a music sound source, a speech sound source, environmental noise, or the like, or may be an unknown sound source, i.e., the type of sound source is not known.

The blind signal separation system S110 may utilize a blind signal separation model to recognize and enhance a sound from a specific sound source, such as speech from a specific speaker. As described in detail below, the blind signal separation model may be a model based on a complex Gaussian distribution. When a sound source type is known, the same type of clean voice signal may be used for the off-line modeling; on the other hand, when a sound source type is not known, the online modeling and a mode of iteratively updating model may be used.

After a mixed voice signal from each sound source are separated by the blind signal separation model, a plurality of separated output voice signals $S_1, S_2 \ldots S_{M-1}$ are generated, from which user may select and enhance a desired voice signal.

Next, a specific example of the method for blind signal separation according to an embodiment of the present disclosure will be described in detail.

Exemplary Method

Figure 2:
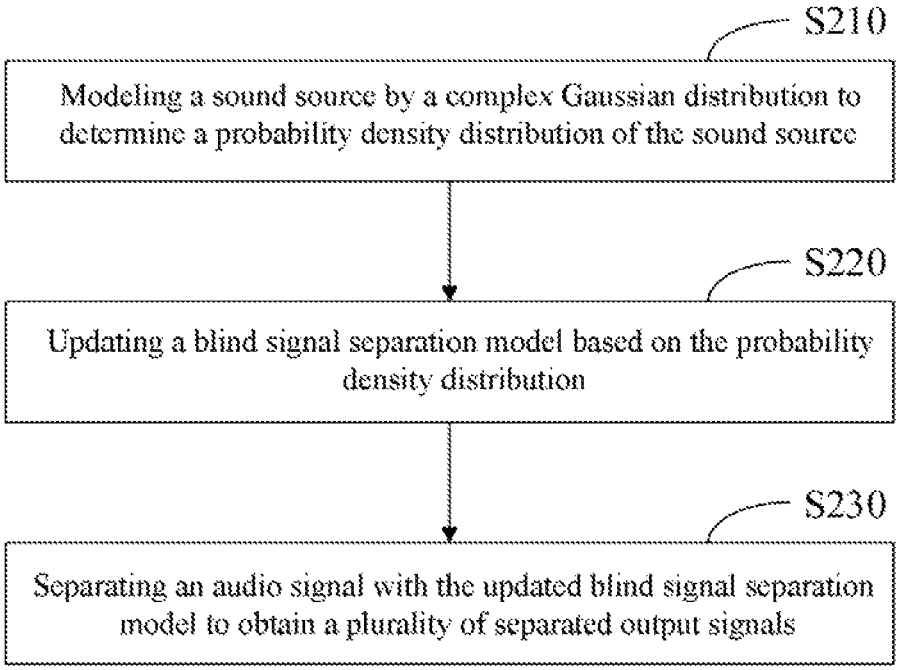
FIG. 2 shows a flowchart of a method for blind signal separation according to an embodiment of the present disclosure.

FIG. 2 shows a flowchart of a method for blind signal separation according to an embodiment of the present disclosure.

As shown in FIG. 2, the method for blind signal separation according to the embodiment of the present disclosure may include: step S210, modeling a sound source by using a complex Gaussian distribution to determine a probability density distribution of the sound source; step S220, updating a blind signal separation model based on the probability density distribution; and step S230, separating an audio signal by using the updated blind signal separation model to obtain a plurality of separated output signals.

In step S210, modeling a sound source by using a complex Gaussian distribution to determine a probability density distribution of the sound source. The modeling step may be performed in various modes. For example, when the type of each sound source is known, a clean audio signal from the same type of sound source may be utilized in advance for an offline modeling to determine the probability density distribution of each sound source. One advantage of the offline modeling is that the modeling efficiency is high and separation effect is good since a known type of clean voice signal is used for modeling. However, the offline modeling is not suitable for a case where a sound source type of a blind signal to be separated is unknown in advance. In this case, the online modeling may be used. In the online modeling, an initial model may be used to separate the blind signal, and then the online modeling may be performed to the separated signals to determine the probability density distribution of their corresponding sound source. In other cases, a combination mode of offline modeling and online modeling may also be used. For example, this mode may be used when a portion of sound source types of blind signals are known, but other sound source types are not known. Specifically, a clean audio signal of a known sound source type is used for offline modeling, while the online modeling is used for an unknown sound source type, and the modeling process is the same as the process of the above offline modeling and online modeling, so as to determine the probability density distribution of each sound source.

Next, in step S220, the blind signal separation model may be determined or updated by using the probability density distribution of each sound source. In an embodiment of the present disclosure, a cost function $Q_{BSS}$ of the blind signal separation model may be expressed as follows:

$$Q_{BSS} = -\sum_{k=0}^{K} \log|\det(W^{(k)})| - \sum_{i=0}^{L} G(y_i)$$

where $W^{(k)}$ is a separation model for the k-th frequency point, $y_i$ represents the separated signals for the i-th sound source, $G(y_i)$ is a contrast function, which is expressed as log $q(y_i)$ and then $q(y_i)$ is the probability density distribution of the i-th sound source. In an embodiment of the present disclosure, as described above, the probability density distribution $q(y_i)$ uses a complex Gaussian distribution instead of the multivariate Laplacian distribution or the super-gaussian distribution in the conventional model. Through modeling a sound source in step S210, parameters of the complex Gaussian distribution $q(y_i)$ of each sound source, such as variance, may be determined. And then using the cost function $Q_{BSS}$, the separation model W may be determined. In step S220, the separation model W may be determined based on the probability density distribution of the sound source and used to update the originally used separation model.

Then in step S230, an audio signal may be separated by using the blind signal separation model W to obtain a plurality of output signals. In the separating step 230, the blind signal may be converted into a frequency domain signal by short-time Fourier transform (STFT), so as to perform separation by the blind signal separation model in the frequency domain. Accordingly, the obtained plurality of output signals are frequency domain signals, and required signals therein may be converted into time domain signals, and then may be output as voice signals through, for example, a microphone.

Those skilled of the art may understand based on the above description and in combination with embodiments described in further detail below that the updating for the blind signal separation model is an iterative process during the above offline modeling process or online modeling process. That is to say, after an audio signal is separated by using the blind signal separation model to obtain a plurality of separated output signals, the modeling is further performed based on the obtained plurality of separated output signals to update the blind signal separation model. Thus, the next frame of audio signal is further separated by using the updated blind signal separation model. In this way, a better separation process suitable for the blind signal being separated may be realized.

For using the online modeling or the offline modeling or a combination of the both in the method for blind signal separation according to the embodiment of the present disclosure, the corresponding blind signal separation system may be realized as an entire-supervised blind signal separation system, a real-time blind signal separation system or a semi-supervised real-time blind signal separation system, which will be further described below.

Figure 3:
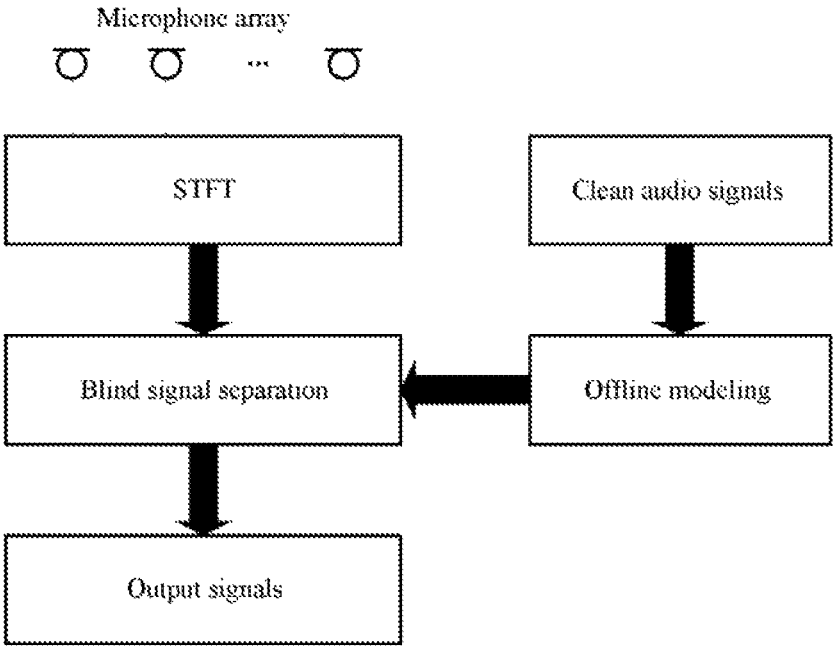
FIG. 3 shows a schematic diagram of an entire-supervised blind signal separation system corresponding to the offline modeling.

FIG. 3 shows a schematic diagram of an entire-supervised blind signal separation system corresponding to the offline modeling. As shown in FIG. 3, the offline modeling is performed by using a clean audio signal of a known sound source type to determine the probability density distribution of the sound source. Since the voice signal used for modeling is known, the modeling process can be referred to as an entire-supervised process, which has a good modeling efficiency and model accuracy. And then, a blind signal separation model may be determined based on the cost function. The signals received by a microphone array are transformed to frequency domain by short-time Fourier transform (STFT), and the blind signal is separated in frequency domain by using a blind signal separation model to obtain a plurality of output signals. The output signal may be transformed back into the time domain for realizing an audio output. In some embodiments, the obtained plurality of output signals may also be modeled to further determine and update the blind signal separation model, and the process may be iteratively performed to realize the best separation effect.

Figure 4:
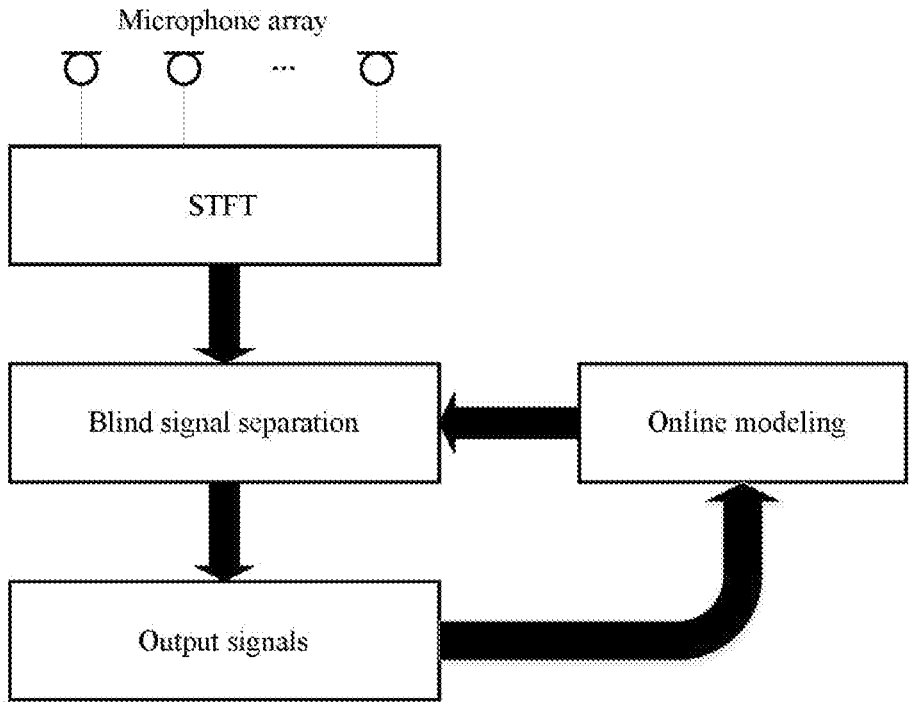
FIG. 4 shows a schematic diagram of a real-time blind signal separation system corresponding to the online modeling.

FIG. 4 shows a schematic diagram of a real-time blind signal separation system corresponding to the online modeling. As shown in FIG. 4, the signal received by a microphone is transformed to the frequency domain by short-time Fourier transform (STFT), and the blind signal is separated in the frequency domain by using an initial blind signal separation model to obtain a plurality of output signals. The online modeling is performed on a plurality of output signals generated by separating to determine a probability density distribution of each sound source of an unknown type and then determine a blind signal separation model. A blind signal separation model determined by the online modeling is used to update the previous used blind signal separation model, and separation of subsequent frames are continued. The process is iteratively performed, and the blind signal separation model is continuously updated, therefore the separation effect is improved. In this process, since the sound source type is unknown in advance, a real-time modeling solution is used.

Figure 5:
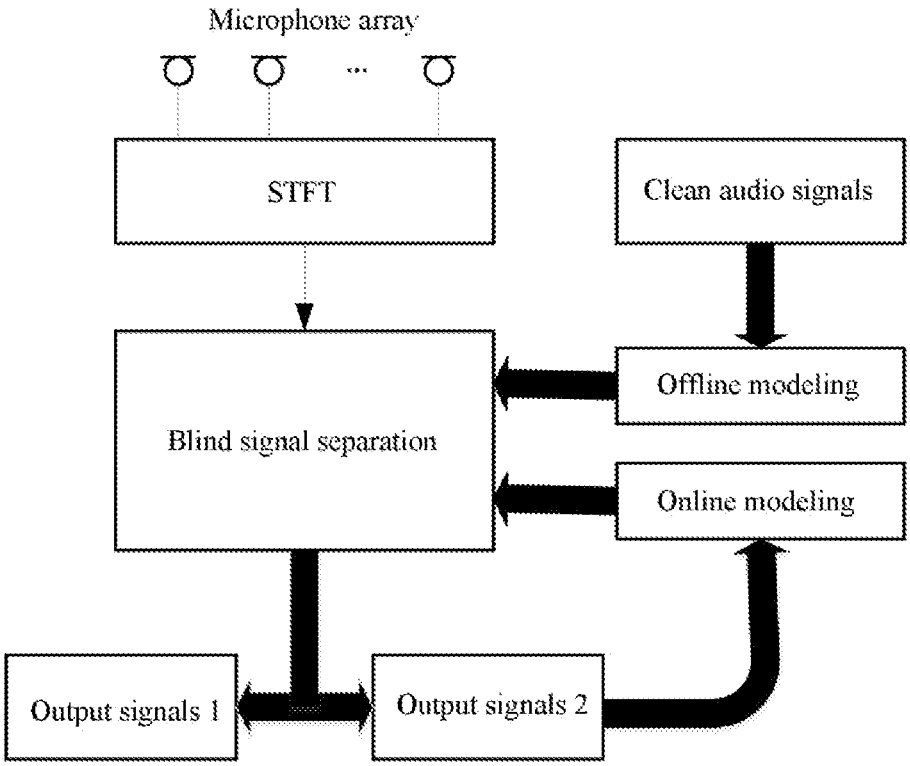
FIG. 5 shows a schematic diagram of a semi-supervised real-time blind signal separation system corresponding to a combination of offline modeling and online modeling.

FIG. 5 shows a schematic diagram of a semi-supervised real-time blind signal separation system corresponding to a combination of offline modeling and online modeling. As shown in FIG. 5, for a portion of sound sources of a known type, the offline modeling may be used to determine their probability density distributions; and for a portion of sound sources of an unknown type, the online modeling is used to determine their probability density distributions. At the initial time, for an unknown sound source, a predetermined initial probability density distribution, such as a random distribution, may be used to determine the separation model in combination with the probability density distribution of known sound source determined by the offline modeling. The signals received by a microphone are transformed to the frequency domain by short Time Fourier Transform (STFT), and separated in the frequency domain by using the determined blind signal separation model to generate an output signal 1 of a known type and an output signal 2 of an unknown type. For an unknown type of output signal 2, the aforementioned online modeling process can be performed to update its probability density distribution, thus updating the blind signal separation model. In some embodiments, the modeling process may also be performed on an output signal 1 of a known type to update its corresponding probability density distribution determined by the offline modeling. In the above process, since a clean audio signal is used to perform modeling only for a portion of sound sources whose types are known, and the real-time modeling is not used on unknown sound sources, therefore, it is also called a semi-supervised real-time modeling system.

A conventional multivariate Laplacian model cannot accurately model the signal to be separated, and a real-time independent vector analysis algorithm may not be able to effectively put forward the signal-to-interference ratio of output signal, however, using the semi-supervised real-time blind signal separation algorithm of the present disclosure may effectively improve the signal-to-interference ratio of separated signals. In an example, real-time separation is performed to a piece of sound signal in which music is mixed with speech by using the method for blind signal separation according to the embodiment of the present disclosure, and the signal-to-interference ratio of microphone data before separation is 10.66 dB, and the separation is performed to a signal by using the real-time independent vector analysis algorithm based on the multivariate Laplacian model, and the signal-to-interference ratio after separation is 9.82 dB, while the separation is performed to a signal by using the semi-supervised real-time blind signal separation system as shown in FIG. 5, wherein the music signal is known, the signal-to-interference ratio after separation is 16.91 dB.

Exemplary Apparatus

Figure 6:
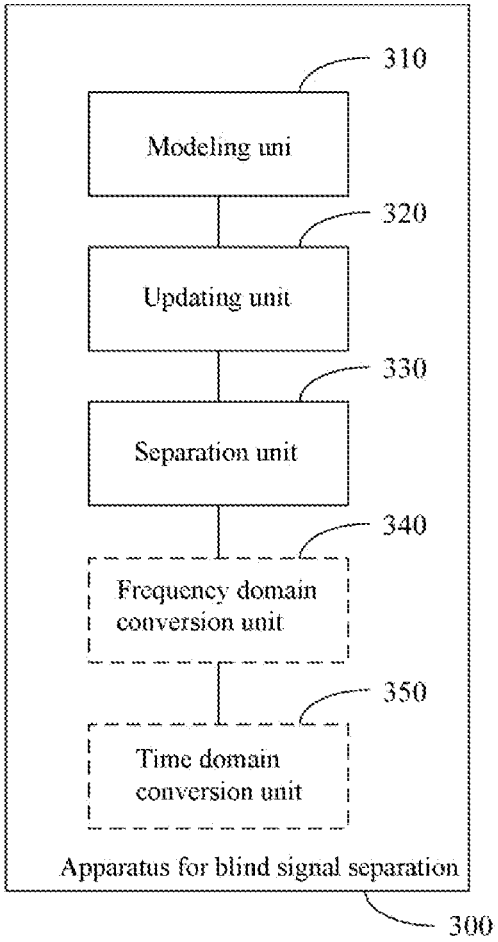
FIG. 6 shows a block diagram of an apparatus for blind signal separation according to an embodiment of the present disclosure.

FIG. 6 shows a block diagram of an apparatus for blind signal separation according to an embodiment of the present disclosure.

As shown in FIG. 6, the apparatus for blind signal separation 300 according to the embodiment of the present disclosure includes: a modeling unit 310 for modeling a sound source by a complex Gaussian distribution to obtain a probability density distribution of the sound source; and an updating unit 320 for updating a blind signal separation model based on the probability density distribution of the sound source; and a separation unit 330 for separating an audio signal by using the updated blind signal separation model to obtain a plurality of separated output signals.

In one example, in the above apparatus for blind signal separation 300, the modeling unit 310 may include at least one of an offline modeling unit and an online modeling unit. The offline modeling unit may be used to perform modeling by using a clean audio signal from a sound source of the same type as the sound source of the audio signal to be separated to obtain a probability density distribution of the sound source. The online modeling unit may be used to perform modeling to a plurality of output signals obtained by separating a previous frame the audio signal to obtain the probability density distribution of each sound source. It may be understood that the offline modeling unit may be used for known sound source types, while the online modeling unit may be used for unknown sound source types. In some embodiments, the modeling unit 310 may also include both an offline modeling unit and an online modeling unit.

The modeling result of modeling unit 310 may be used to the updating unit 320 to update a blind signal separation model, and thus the separation unit 330 uses the separation model to separate an audio signal to generate a plurality of outputs. It should be understood that the process may be performed iteratively. That is to say, the modeling unit 310 may perform modeling to one or more of the plurality of outputs generated by the separation unit 330 to continuously update the blind signal separation model to realize a better separation effect.

In one example, the apparatus for blind signal separation 300 may further include: a frequency domain conversion unit 340 for converting an audio signal into a frequency domain signal so as to separate in the frequency domain, and the plurality of separated output signals are also frequency domain signals; and a time domain conversion unit 350 for converting at least one of the separated frequency domain output signals into a time domain signal so as to be an audio output.

It can be understood that the specific function and operation of various units and modules of the above apparatus for blind signal separation 300 have been described in detail in the above description with reference to FIG. 1 to FIG. 5, so only a brief description will be given here, and repeated detailed description will be omitted.

As described above, the apparatus for blind signal separation 300 according to the embodiment of the present disclosure may be realized by various terminal devices, such as an audio processing device for voice signal separation and the like. In one example, the apparatus 300 according to the embodiment of the present disclosure may be integrated into a terminal device as a software module and/or a hardware module. For example, this apparatus 300 may be a software module of an operating system of this terminal device, or may be an application program developed for this terminal device; of course, this apparatus 300 may also be one of the numerous hardware modules of this terminal device.

Alternatively, in another example, this apparatus for blind signal separation 300 and this terminal device may also be separated devices, and this apparatus 300 may be connected to this terminal device through a wired and/or wireless network and transmit interactive information according to a predetermined data format.

Exemplary Electronic Device

Figure 7:
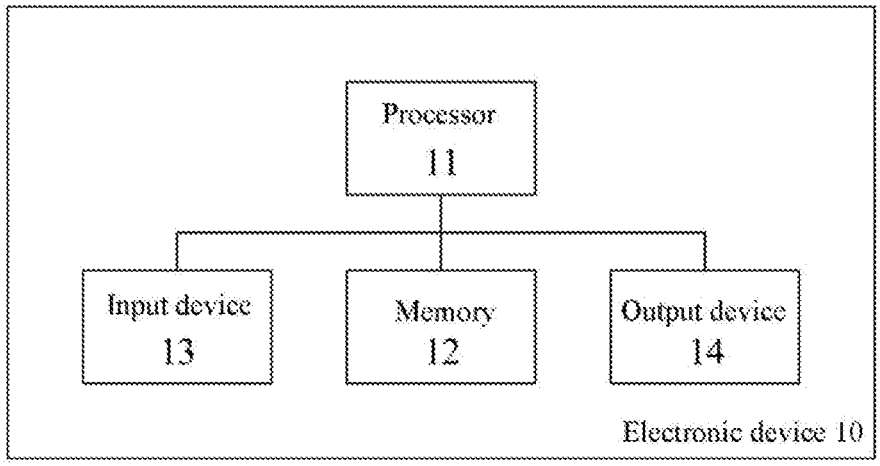
FIG. 7 shows a block diagram of an electronic device according to an embodiment of the present disclosure.

Hereinafter, an electronic device according to an embodiment of the present disclosure will be described with reference to FIG. 7. As shown in FIG. 7, electronic device 10 includes one or more processors 11 and memories 12.

The processor 11 may be a central processing unit (CPU) or other forms of processing unit having data processing capabilities and/or instruction execution capabilities, and may control other assemblies within the electronic device 10 to execute the desired functions.

The memory 12 may include one or more computer program products that may include various forms of computer readable storage medium, such as volatile memory and/or non-volatile memory. The volatile memory may include, for example, a random access memory (RAM) and/or a cache, etc. The non-volatile memory may include, for example, a read only memory (ROM), a hard disk, a flash memory, etc. One or more computer program instructions may be stored in the computer readable storage medium, and the processor 11 may run the program instructions, to implement the method for blind signal separation and/or other desired functions of various embodiments of the present disclosure as described above. A clean audio signal of a known sound source type or the like may also be stored in the computer readable storage medium.

In an example, the electronic device 10 may also include an input device 13 and an output device 14, and these assemblies are interconnected by a bus system and/or other forms of connection mechanism (not shown).

For example, this input device 13 may be a microphone or an array of microphones for capturing input signals from a sound source in real time. This input device 13 may also be various input interfaces, such as a communication network connector, for receiving digitized audio signals from outside. Further, the input device 13 may also include, for example, a keyboard, a mouse, or the like.

The output device 14 may output various information to the outside, including a plurality of separated output signals, etc. The output device 14 may include, for example, a display, a speaker, and a communication network interface and remote output devices to which it is connected, and the like.

Of course, for simplicity, only some of the assemblies related to the present disclosure in the electronic device 10 are shown in FIG. 7, and assemblies such as a bus, an input/output interface, and the like are omitted. In addition, the electronic device 10 may include any other suitable assemblies depending on the specific application.

Exemplary Computer Program Product and Computer Readable Storage Medium

In addition to the method and apparatus described above, embodiments of the present disclosure may also be a computer program product which comprises computer program instructions, and said computer program instructions, when executed by a processor, make the processor to perform steps of the method for blind signal separation according to various embodiments of the present disclosure as described in the above-mentioned "exemplary method" portion of the present disclosure.

The computer program product may write program code for performing operations of embodiments of the present disclosure in any combination of one or more programming languages, said programming languages include object-oriented programming languages, such as Java, C++, etc., and conventional procedural programming languages, such as "C" language or similar programming languages. The program code may be executed entirely on a user computing device, be partially executed on a user device, be executed as a stand-alone software package, be partially executed on a user computing device and be partially executed on a remote computing device, or be entirely executed on a remote computing device or server.

Furthermore, embodiments of the present disclosure may also be a computer readable storage medium having computer program instructions stored thereon, and said computer program instructions, when executed by a processor, make the processor to perform steps of a method for blind signal separation according to various embodiments of the present disclosure as described in the above-mentioned "exemplary method" portion of the present disclosure.

The computer-readable storage medium may use any combination of one or more readable mediums. The readable medium may be a readable signal medium or a readable storage medium. The computer-readable storage medium may include, but not limited to, a system, an apparatus, or a device of electric, magnetic, optical, electromagnetic, infrared, or semiconductor, or any combination of the above. More specific examples (a non-exhaustive list) of readable storage medium include an electrical connection with one or more wires, a portable disk, a hard disk, a random access memory (RAM), a read only memory (ROM), an erasable programmable read only memory (EPROM or flash memory), an optical fiber, a portable compact disk read only memory (CD-ROM), an optical storage device, a magnetic storage device, or any suitable combination of the above.

The basic principles of the present application are described above in conjunction with the specific embodiments, however, it is necessary to point out that the advantages, superiorities, and effects and so on mentioned in the present application are merely examples but not intended to limit the present invention, and these advantages, superiorities, effects and so on will not be considered as essential to the embodiments of the present application. In addition, the specific details of the foregoing disclosure are only for the purpose of illustration and ease of understanding but not for the purpose of limitation, and the above details do not limit the application to be implemented in the specific details mentioned above.

The block diagrams of devices, apparatuses, equipment, systems referred to in the present application are merely illustrative examples and are not intended to require or imply that the connections, arrangements, and configurations must be made in the manner shown in the block diagrams. As those skilled in the art will recognize, these devices, apparatuses, equipment, systems may be connected, arranged, or configured in any manner. Terms such as "including", "comprising", "having" and the like are open words, which means "including but not limited to" and may be used interchangeably. The terms "or" and "and" as used herein refer to the term "and/or" and may be used interchangeably, unless the context clearly dictates otherwise. The term "such as" as used herein refers to the phrase "such as but not limited to" and is used interchangeably.

It should also be noted that in the apparatus, equipment, and the method of the present application, each component or each step may be decomposed and/or recombined. These decompositions and/or recombination should be regarded as an equivalent of the present application.

The above description of the disclosed aspects is provided to enable any of those skilled in the art to make or use the application. Various modifications to these aspects are very obvious for those skilled in the art, and the generic principles defined herein may be applied to other aspects without departing from the scope of the application. Therefore, the present application is not intended to be limited to the aspects shown herein, but rather to present the broadest scope consistent with the principles and novel features disclosed herein.

The above description has been provided for the purposes of illustration and description. In addition, this description is not intended to limit the embodiments of the present application to the forms disclosed herein. Although various example aspects and embodiments have been discussed above, those skilled in the art will recognize certain variations, modifications, alterations, additions and sub-combinations thereof.

What is claimed is:

1. A method for blind signal separation, comprising:

modeling a sound source by a complex Gaussian distribution to determine a probability density distribution of the sound source;

updating a blind signal separation model based on the probability density distribution; and separating an audio signal by the updated blind signal separation model to obtain a plurality of separated output signals.

2. The method for blind signal separation of claim 1 wherein a cost function of the blind signal separation model is as follows:

$$Q_{BSS} = -\sum_{k=0}^{K} \log|\det(W^{(k)})| - \sum_{i=0}^{L} G(y_i)$$

where $W^{(k)}$ is a separation model for the k-th frequency point, $y_i$ represents a separated signal for the i-th sound source, $G(y_i)$ is a contrast function and expressed as log $q(y_i)$, where $q(y_i)$ is the probability density distribution of the i-th sound source.

3. The method for blind signal separation of claim 1 wherein modeling a sound source by a complex Gaussian distribution comprises offline modeling, online modeling, or a combination thereof.

4. The method for blind signal separation of claim 3 wherein the offline modeling comprises:

modeling by using a clean audio signal from a sound source of the same type as the sound source of the audio signal to be separated, to obtain the probability density distribution of the sound source.

5. The method for blind signal separation of claim 4, further comprising:

updating the blind signal separation model based on the obtained plurality of separated output signals.

6. The method for blind signal separation of claim 3 wherein the online modeling comprises:

modeling a plurality of output signals obtained by separating a previous frame of the audio signal, to obtain the probability density distribution of each sound source.

7. The method for blind signal separation of claim 3 wherein the combination of offline modeling and online modeling comprises:

performing offline modeling to a portion of sound sources of the audio signal to be separated; and performing online modeling to remaining sound sources of the audio signal to be separated.

8. The method for blind signal separation of claim 7 wherein the portion of sound sources are known sound sources, and the remaining sound sources are unknown sound sources.

9. The method for blind signal separation of claim 1 wherein separating an audio signal by the updated blind signal separation model comprises:

converting the audio signal into a frequency domain signal so as to perform separation in the frequency domain, and the plurality of separated output signals being frequency domain signals.

10. The method for blind signal separation of claim 9, further comprising:

converting at least one of the plurality of separated output signals into a time domain signal.

11. An apparatus for blind signal separation, comprising:

a modeling unit configured to model a sound source by a complex Gaussian distribution to determine a probability density distribution of the sound source;

an updating unit configured to update a blind signal separation model based on the probability density distribution of the sound source; and a separation unit configured to separate an audio signal by the updated blind signal separation model to obtain a plurality of separated output signals.

12. The apparatus for blind signal separation of claim 11 wherein the modeling unit comprises at least one of an offline modeling unit and an online modeling unit.

13. The apparatus for blind signal separation of claim 12 wherein the offline modeling unit is configured to model by using a clean audio signal from a sound source of the same type of as the sound source of the audio signal to be separated to obtain a probability density distribution of the sound source, and the online modeling unit is configured to model a plurality of output signals obtained by separating a previous frame of the audio signal, to obtain the probability density distribution of each sound source.

14. The apparatus for blind signal separation of claim 13 wherein the modeling unit comprises both an offline modeling unit and an online modeling unit, wherein the offline modeling unit is configured to perform offline modeling to known sound sources of the audio signal to be separated, and the online modeling unit is configured to perform online modeling to unknown sound sources of the audio signal to be separated.

15. The apparatus for blind signal separation of claim 11, further comprising:

a frequency domain conversion unit configured to convert the audio signal into a frequency domain signal so as to perform separation in frequency domain, and the plurality of separated output signals are frequency domain signals; and a time domain conversion unit configured to convert at least one of the separated frequency domain output signals into a time domain signal.

16. An electronic device, comprising:

a processor; and a memory having computer program instructions stored therein, the computer program instructions enable the processor to perform a method for blind signal separation when executed, wherein the method comprises:

modeling a sound source by a complex Gaussian distribution to determine a probability density distribution of the sound source;

updating a blind signal separation model based on the probability density distribution; and separating an audio signal by the updated blind signal separation model to obtain a plurality of separated output signals.

* * * * *